US009359781B2

(12) United States Patent
Lan

(10) Patent No.: US 9,359,781 B2
(45) Date of Patent: Jun. 7, 2016

(54) POOL SYSTEMS AND METHODS FOR MAKING AND USING SAME

(71) Applicant: Polygroup Macau Limited (BVI), Tortola (VG)

(72) Inventor: Chao Long Lan, Shenzhen (CN)

(73) Assignee: POLYGROUP MACAU LIMITED (BVI), Tortola (VG)

( * ) Notice: Subject to any disclaimer, the term of this patent is extended or adjusted under 35 U.S.C. 154(b) by 0 days.

(21) Appl. No.: 14/104,149

(22) Filed: Dec. 12, 2013

(65) Prior Publication Data

US 2014/0157509 A1 Jun. 12, 2014

Related U.S. Application Data

(60) Provisional application No. 61/736,424, filed on Dec. 12, 2012.

(51) Int. Cl.
*E04H 4/00* (2006.01)

(52) U.S. Cl.
CPC ..... *E04H 4/0031* (2013.01); *E04H 4/0056* (2013.01); *Y10T 29/49826* (2015.01)

(58) Field of Classification Search
USPC ..... 4/506, 513
See application file for complete search history.

(56) References Cited

U.S. PATENT DOCUMENTS

| | | | | |
|---|---|---|---|---|
| 7,784,227 | B2 * | 8/2010 | Ribeiro | 52/169.7 |
| 2002/0029431 | A1 * | 3/2002 | Oikawa et al. | 15/77 |
| 2006/0162061 | A1 * | 7/2006 | Liu | 4/506 |
| 2006/0162062 | A1 * | 7/2006 | Liu | 4/506 |
| 2012/0023655 | A1 * | 2/2012 | Junquet | 4/513 |

* cited by examiner

*Primary Examiner* — Lauren Crane
(74) *Attorney, Agent, or Firm* — Troutman Sanders LLP; Ryan A. Schneider; Benjamin C. Wiles

(57) ABSTRACT

Embodiments of the present invention provide an improved pool. Embodiments of the present invention also provide a method of making an improved pool. The pool can comprise an integrated sidewall joined to a floor portion. The integrated sidewall can be constructed from one piece of material, and can have fewer seams than traditional pools, thereby reducing the likelihood that that pool will rupture and leak. In some embodiments, since the pool has fewer seams than traditional pools, fewer manufacturing steps are required to make the pool. This can increase manufacturing speed and decrease cost.

19 Claims, 5 Drawing Sheets

POOL SYSTEMS AND METHODS FOR MAKING AND USING SAME

CROSS-REFERENCE TO RELATED APPLICATION AND PRIORITY CLAIM

This application claims the benefit, under 35 U.S.C. §119 (e), of U.S. Provisional Patent Application No. 61/736,424, filed 12 Dec. 2012, entitled "POOL SYSTEMS AND METHODS FOR MAKING AND USING SAME," the entire contents and substance of which is incorporated herein by reference in its entirety as if fully set forth below.

BACKGROUND

1. Field of the Invention

Embodiments of the present invention relate to a container and, more particularly, to systems and methods for providing an improved pool.

2. Description of Related Art

A variety of pools are known. Simply described, pools are containers of water for people to swim, wade, relax, and play in. In their many forms, pools can be above-ground pools that extend up from the ground, or below-ground pools that extend down into the ground. Above ground pools can sometimes be temporary, providing relaxation and enjoyment along with the ability to be removed and stored after use. Below ground pools, however, are usually more permanent.

Many types of above ground pools exist. Some designs, for example, are inflatable. These designs comprise a hollow sidewall that can be inflated to provide a containing system for water. In use, air is pumped or blown into the sidewall, and the sidewall expands and takes on the shape of a pool. Since the sidewall is attached to a pool floor, the entire system can be filled to provide an area where users can swim, wade, relax, and play. These inflatable systems can vary in size from small kiddie pools to larger pools that can accommodate several adults. Inflatable pools, however, required the use of a pump or blowing by mouth to fill with air.

As shown in FIG. 1, another type of above ground pool is a frame pool 100 (exploded in FIG. 1). Frame pools 100 comprise a sidewall 105 and floor 110 made from a thin flexible material, and the sidewall 105 and floor 110 together form a shell 115. The shell 115 is supported by a frame (not shown) that holds the sidewalls 105 of the flexible material above the ground and provides the shape of the pool 100. The pool 100 can then be filled with water. The hydrostatic pressure from the water pushes out on the flexible material, giving the shell 115 its shape against the frame. Frame pools 100 have the advantage of being easy to assemble for use and disassemble for storage without requiring inflation by a pump or person.

Conventional frame pools 100 are manufactured by integrating several large sheets of flexible material into a shell. More specifically, as shown in FIG. 1, several large sheets 120 that each comprise at least one sidewall section 105 and a floor section 110 are joined to form the shell 115. In these designs, the sheets 120 must be joined along several lengthy seams 150 that span the sidewall 105 and floor 110 of the pool 100. Joining these seams 150 requires several manufacturing steps, leading to increased manufacturing time. In addition, because the sheets 120 are manufactured from flat layers of material, conventional designs require large corner sections 125 to be integrated proximate the corners of the pool 100 in order to give the pool 100 a rounded shape. These features result in designs with several components and multiple long seams 150. Because the seams 150 are the most likely place for the shell 115 to fail, traditional designs can encounter failure more often, or earlier, than users would like.

Moreover, in many pools 100, the most likely place for the shell to fail is at a seam 150 that that is on a sidewall 105 and near the bottom of the pool 100. This is because the bottom sidewall 105 of the pool 100 is subject to high hydrostatic pressure, and is not supported by the ground under the pool 100. In addition, this portion of the pool 100 is often kicked and bumped by people in the pool, further weakening it. Thus, it would be preferable to have a pool 100 wherein the number of seams 150 on the sidewall 105 near the bottom of the pool is minimized or eliminated.

Accordingly, there is a need for a pool with a reduced number of areas prone to failure. More specifically, there is a need for a pool with fewer components and fewer seams. In addition, the seams should be shorter and strategically placed. The pool should also enable faster, more efficient manufacturing with fewer steps and fewer components. Various embodiments of the present invention address these desires.

SUMMARY

Briefly described, embodiments of the present invention relate to container, such as a pool. In some embodiments, the pool comprises fewer and shorter seams than similar conventional pools. The pool is therefore more durable than comparable conventional pools, and has a reduced likelihood of rupturing. Moreover, in some embodiments, the pool requires fewer components and fewer welding steps during manufacturing. The pool is therefore easier and less expensive to manufacture than similar traditional pools.

In some embodiments, the pool can comprise an integrated sidewall and a floor portion made from one or more sheets. The integrated sidewall can be formed from one long, substantially rectangular sheet of flexible material. In some embodiments, the ends of the sheet can be joined to form an integrated sidewall with only one seam. Thus, the sidewalls of the pool can be formed from one sheet of material comprising only one seam. This is in contrast to conventional pools that require several sheets and several seams. The use of only one seam, as opposed to several, reduces the likelihood that the pool will rupture, and reduces the amount of welding, and number of welding steps, required during manufacturing.

In some embodiments, the integrated sidewall can be joined to the floor portion. The floor portion can comprise one sheet of flexible material, or a plurality of sheets of flexible material. In one embodiment, the floor portion comprises three sheets of flexible material that are joined together. Once the sidewall and floor portion are joined, an upward force providing member can be used to support the sidewalls and provide shape to the pool. The pool can then be filled with water and used for swimming, relaxing, and any other purposes desired by the users.

In some embodiments a fluid container may comprise a shell and a support for keeping the upper portion elevated off the ground. The shell may comprise a substantially vertical unitary sidewall having an upper portion and a lower portion, and a substantially horizontal floor portion attached to the lower lip section of the unitary sidewall with a substantially horizontal seam. The lower portion may comprise a lower lip section. The unitary sidewall may be formed from a single, generally rectangular sheet. The container may further comprise corner patches that may be attached to both the unitary sidewall as well as the floor portion. In some embodiments, the floor portion may be a single sheet, and in others, the floor portion may comprise a plurality of sheets joined with horizontal seams.

The unitary sidewall may comprise one or more receiving portions for receiving a support frame in some embodiments a fluid container. In addition or alternatively, some embodiments according to the present disclosure may have a support that comprises one or more flotation regions on the upper portion of the unitary sidewall. In some embodiments the floor portion may be substantially rectangular, rectangular with rounded corners, square, square with rounded corners, circular, oval, oblong, elliptical, triangular, pentagonal, hexagonal, octagonal, or decagonal. The seams relating to a container according to the present disclosure may be created by welding, RF welding, sewing, laminating, gluing, adhering, fastening, attaching, or sticking one portion of the unitary sidewall to a second portion of the unitary sidewall. In some embodiments, the unitary sidewall and floor portion may comprise polyurethane, PVC, nylon, vinyl, or a textile coated with a material impermeable to water.

Another aspect of the present disclosure may involve a method for assembling a fluid container. In some embodiments, a method may comprise providing a plurality of sheets of a flexible material, wherein at least one of the plurality of sheets may be a substantially vertical integrated sidewall and at least another of the plurality of sheets may be a substantially horizontal floor portion. A method of the present disclosure may further comprise joining a first portion of the integrated sidewall to a second portion of the integrated sidewall with a substantially vertical seam, and joining the integrated sidewall to the floor portion with a substantially horizontal seam.

According to the present disclosure, a method of joining two or more portions of the plurality of sheets could comprise welding, RF welding, sewing, laminating, gluing, adhering, fastening, attaching, or sticking the portions together. Furthermore, a method according to the present disclosure may comprise joining two or more of the plurality of sheets to form the floor portion with one or more substantially horizontal seams. A method of the present disclosure may further comprise providing a plurality of corner patches, and joining the corner patches to the integrated sidewall and the floor portion with a single substantially continuous seam.

Some embodiments of the present disclosure may comprise providing a support for keeping an upper portion of the integrated sidewall elevated above the floor portion. A method of the present disclosure may comprise a frame, and may involve connecting the upper portion of the integrated sidewall to the frame. In addition or alternatively, some embodiments according to the present disclosure may include a support that comprises a floatation device connected to the upper portion of the integrated sidewall. In some embodiments, providing a plurality of sheets of a flexible material may comprise providing a plurality of sheets of polyurethane, PVC, nylon, vinyl, or a textile coated with a material impermeable to water.

In some embodiments a fluid container may comprise a shell and a frame connected to a receiving portion for keeping the upper portion elevated off the ground. A shell of the present disclosure may comprise a substantially vertical integrated sidewall formed from a single, generally rectangular sheet, a substantially horizontal floor portion attached to the lower lip section of the integrated sidewall with a substantially horizontal seam, and at least one corner patch attached to both the integrated sidewall and the floor portion. In some embodiments the substantially vertical integrated sidewall may comprise an upper portion comprising a receiving portion, a lower portion comprising a lower lip section, and a single vertical seam that attaches a first portion of the integrated sidewall to a second portion of the integrated sidewall.

These and other aspects of the present invention are described in the Detailed Description below and the accompanying figures. Other aspects and features of embodiments of the present invention will become apparent to those of ordinary skill in the art upon reviewing the following description of embodiments of the present invention in concert with the figures. While features of the present invention may be discussed relative to certain embodiments and figures, all embodiments of the present invention can include one or more of the features discussed herein. While one or more embodiments may be discussed as having certain advantageous features, one or more of such features may also be used with the various embodiments of the invention discussed herein. In similar fashion, while exemplary embodiments may be discussed below as system or method embodiments, it is to be understood that such exemplary embodiments can be implemented in various devices, systems, and methods of the present invention.

BRIEF DESCRIPTION OF THE DRAWINGS

Various features and advantages of the present invention may be more readily understood with reference to the following detailed description taken in conjunction with the accompanying drawing figures, wherein like reference numerals designate like structural elements, and in which.

DETAILED DESCRIPTION

Figure 1:
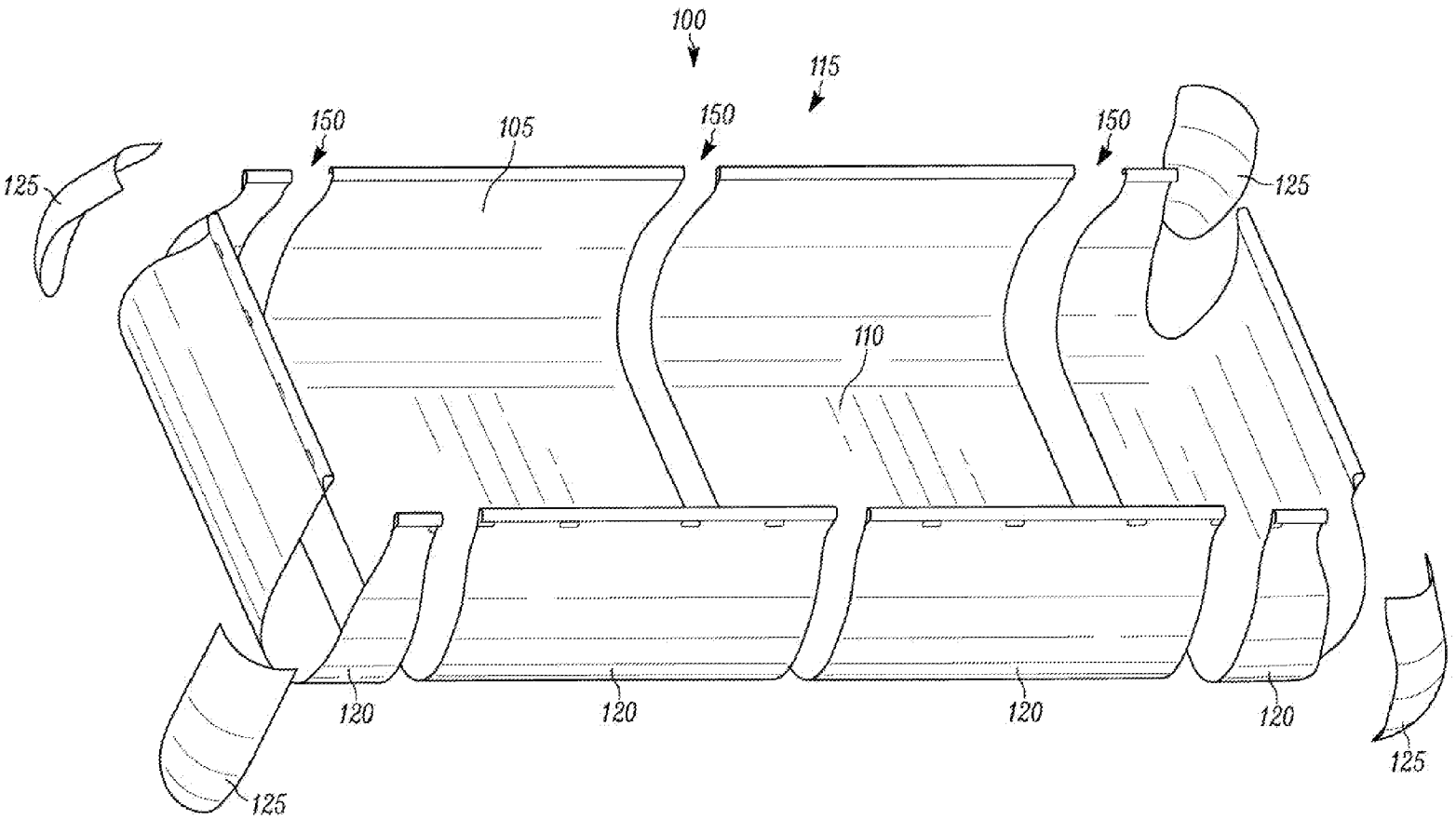
FIG. 1 Prior Art
FIG. 1 is a perspective, exploded view of a conventional frame pool.

To facilitate an understanding of the principles and features of the various embodiments of the invention, various illustrative embodiments are explained below. Although exemplary embodiments of the invention are explained in detail as being a frame pool or swimming pool in general, it is to be understood that other embodiments are contemplated, such as embodiments that serve as containers of various sizes and for various purposes. Accordingly, where the terms "pool," "swimming," and related terms are used throughout this disclosure, it will be understood that other entities, objects, or activities can take the place of these in various embodiments of the invention. For example, and not limitation, some exemplary embodiments of the invention may improve other containers, such as buckets, tarps, food and beverage containers, coolers, and the like. It is not intended that the invention is limited in its scope to the details of construction and arrangement of components set forth in the following description or examples. The invention is capable of other embodiments and of being practiced or carried out in various ways. Also, in describing the exemplary embodiments, specific terminology will be resorted to for the sake of clarity.

It must also be noted that, as used in the specification and the appended claims, the singular forms "a," "an" and "the" include plural references unless the context clearly dictates otherwise. For example, reference to a component is intended also to include composition of a plurality of components.

References to a composition containing "a" constituent is intended to include other constituents in addition to the one named. Furthermore, it is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified.

The materials described as making up the various elements of the invention are intended to be illustrative and not restrictive. Many suitable materials that would perform the same or a similar function as the materials described herein are intended to be embraced within the scope of the invention. Such other materials not described herein can include, but are not limited to, for example, materials that are developed after the time of the development of the invention.

As explained above, and as shown in FIG. 1, a problem with traditional pools 100 is that they comprise long seams 150 that extend along the sidewalls 105 and floor 110 of the pool 100. The seams are formed when several large sheets 120 that each comprise at least one sidewall section 105 and a floor section 110 are joined together. The result is a shell 115 with lengthy seams 150 that span the sidewalls 105 and floor 110 of the pool 100, including the area on the sidewalls 105 near the floor 110 of the pool 100.

Typically, long seams 150 are more prone to rupture than short seams because they provide an increased length along which the seam 150 can fail. In addition, seams 150 located on the sidewalls 105 near the floor 110 of the pool 100 are prone to failure because of the high hydrostatic pressure exerted on the seams 150, their susceptibility to contact by users, and the lack of additional reinforcement the seams 150 usually receive. As a result, the seams 150 of traditional pools sometimes rupture, causing the pool 100 to leak, which can require significant repairs or disposal of the pool 100. It would therefore be beneficial to minimize the length of seams 150 and/or the presence of seams 150 in sensitive areas, such as on the bottom sidewall. It would also be beneficial, for reasons of manufacturing and material cost, to reduce the number of components required to manufacture a pool 100, and the number of steps required during manufacturing.

Embodiments of the present invention provide several exemplary containers that can be used as a pool, such as, for example, a swimming pool, kiddie pool, or wading pool. In some embodiments, the present invention can comprise a frame pool. Similarly, embodiments of the present invention can comprise a shell for a frame pool. The shell can comprise shorter seams than traditional shells, and can eliminate the presence of seams near the bottom of the sidewall (i.e., on the vertical portion of the sidewall near the floor of the pool). Accordingly, the present invention can minimize the potential that the pool will rupture or fail, leading to a leak that requires disposing of the pool or making a significant repair. The present invention also minimizes the amount of joining, or welding, required to manufacture a pool. The present invention can therefore reduce manufacturing costs.

Figure 2:
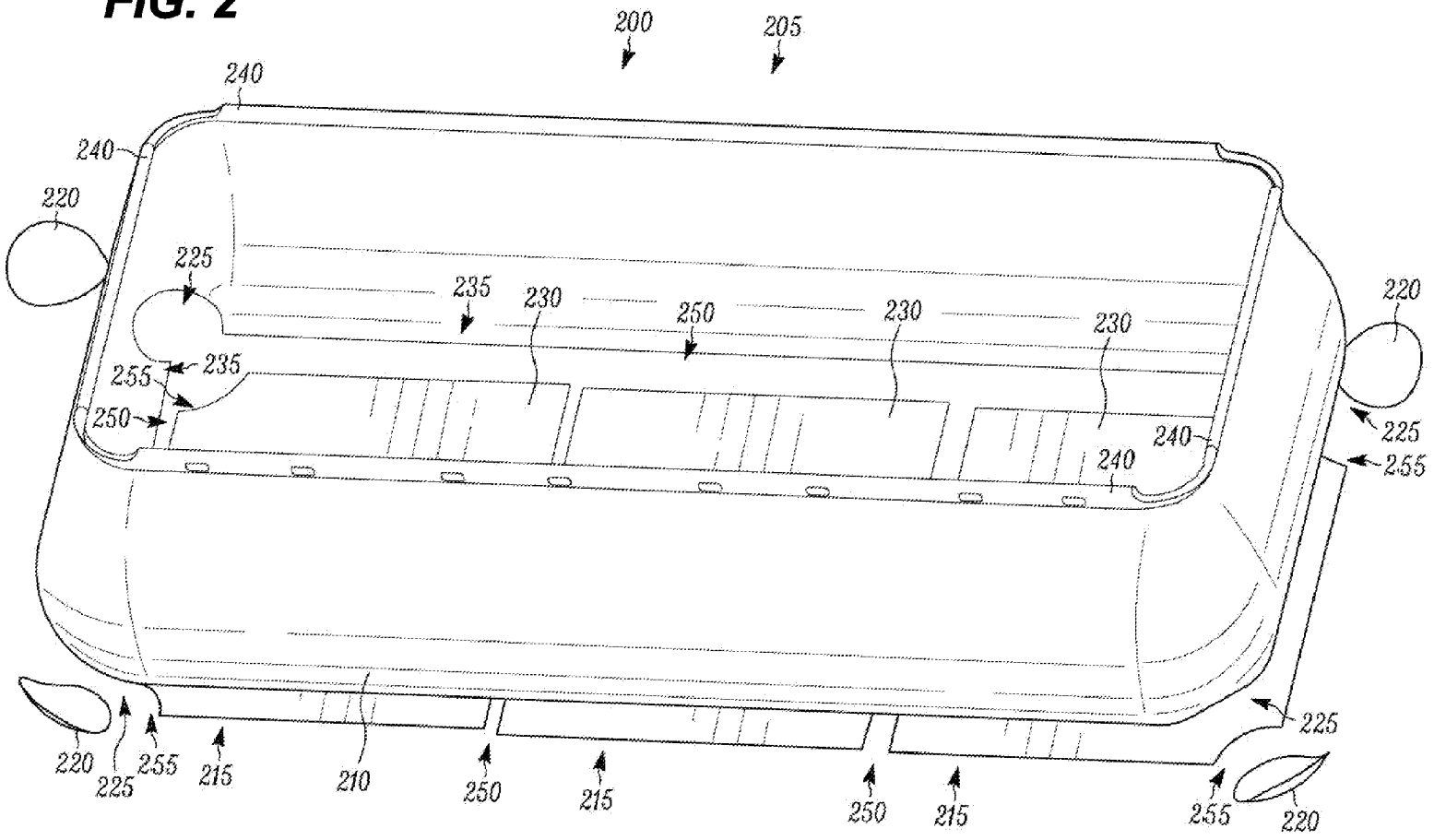
FIG. 2 is a perspective, exploded view of an improved pool, in accordance with some embodiments of the present invention.

As shown in FIG. 2, the present invention can be a container, such as a pool 200. The pool 200 can be a frame pool, and can comprise a shell 205. The shell 205 can comprise an integrated sidewall 210 and a base or floor portion 215. The shell can further comprise one or more corner patches 220. In some embodiments, the components of the shell 205 are joined at one or more seams 250. Those of skill in the art will understand that the seams 250 are shown as exploded (i.e., not attached) in FIG. 2, but are shown as attached in FIG. 3.

In some embodiments, the integrated sidewall 210 can be made from one long, substantially rectangular sheet of flexible material. Accordingly, one piece of material, instead of several, can be used to form the sidewalls 210 of the shell, and thus the sidewalls 210 of the pool 200. In other embodiments, however, a plurality of sheets can be joined to form the integrated sidewall 210.

As described above, in some embodiments, one long, substantially rectangular sheet of flexible material can be used to manufacture the sidewalls 210 of the pool 200. Advantageously, the use of one sheet reduces the number of seams 250 on the sidewall 210. More particularly, in some embodiments, the use of one sheet reduces the number of seams 250 from several (usually six or more) to one, the one seam 250 joining the ends of the integrated sidewall 210 together as the sidewall 210 "loops around" on itself. The shell 205 can therefore have a reduced number of seams 250 on its sidewalls 210, including near the bottom of the pool 200. Thus, in some embodiments, the reduced number of seams 250 means that the pool 200 has a reduced number of locations where the pool 200 is prone to rupture. Moreover, the reduced number of seams means that fewer joining steps are required during manufacturing, which can reduce cost and decrease manufacturing time.

Figure 3:
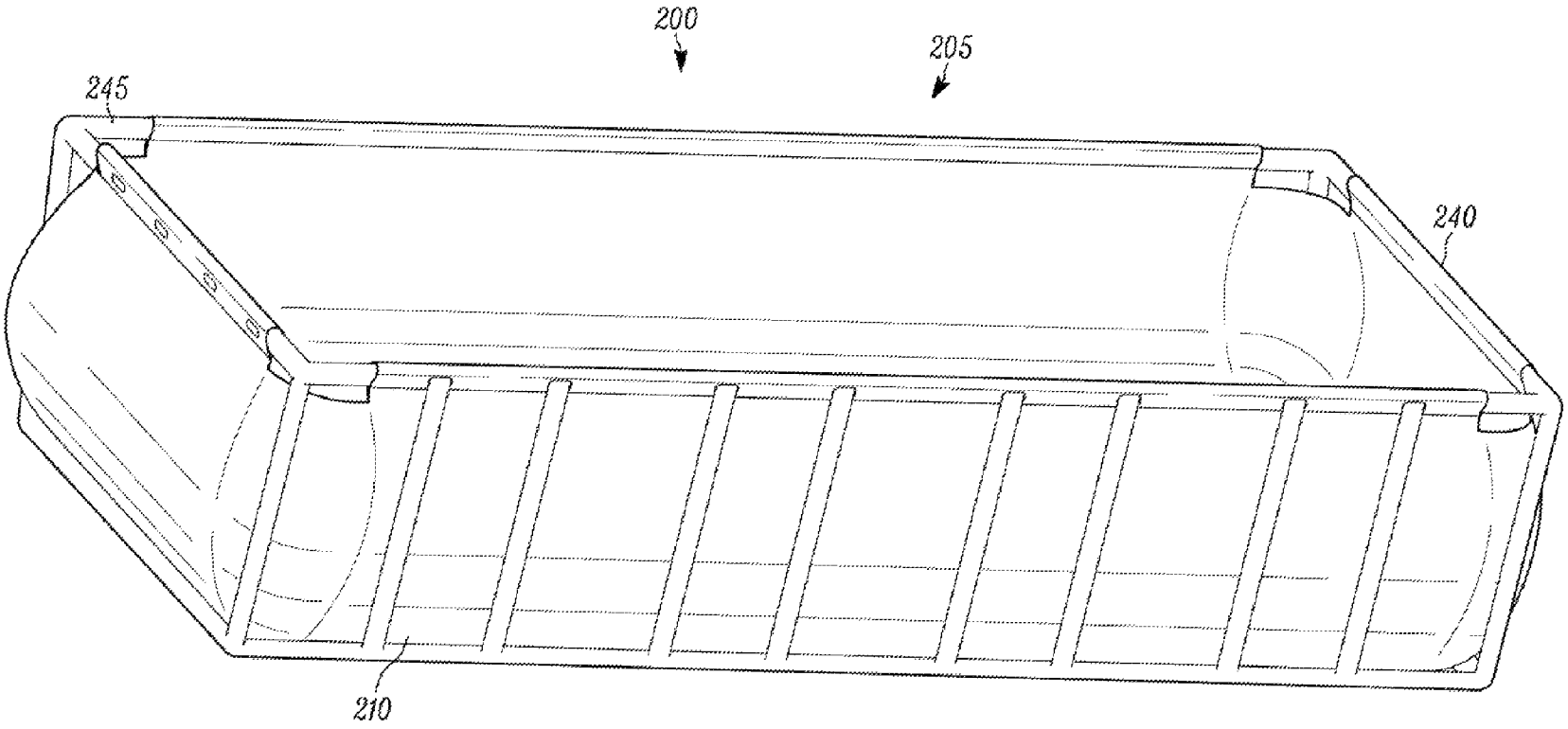
FIG. 3 is a perspective view of an improved pool, in accordance with some embodiments of the present invention.

In some embodiments, to facilitate manufacturing, the sidewall 210 can be formed with open corner sections 225. The open corner sections 225 can enable the sidewall 210 to take on a desirable shape while enabling the sidewall 210 to be cut from one continuous, flat piece of material (i.e., from one sheet). More specifically, as can be seen in FIGS. 2-3, the open corner sections 225 can allow the sidewall 210 to have rounded corners and a slight bulge near the bottom. These features can allow the sidewall 210 to better allocate the pressure applied to it by the water in the pool 200. This, in turn, can reduce the likelihood of a pressure induced rupture of the shell 205.

In some embodiments, the floor portion 215 is made from one or more sheets 230 of a flexible material. In embodiments where the floor portion 215 is made from a plurality of sheets 230, the sheets can be joined together to form a single floor portion 215. The perimeter of the floor portion 215, or an area near the perimeter, can then be joined with the sidewall 210 to form at least part of the shell 205.

In some embodiments, as shown in FIG. 2, the floor portion 215 comprises three sheets 230 joined together. In other embodiments, however, the floor portion 215 can comprise one, two, four, or five sheets 230. In some embodiments, the floor portion 215 can comprise from one to approximately twenty sheets 230. As shown in FIG. 2, the sheets 230 can be substantially rectangular, and can span the length, width, or both of the floor portion 215. Those of skill in the art will understand, however, that the sheets 230 can be a variety of shapes and sizes, including triangular.

One advantage of the present invention is that, since the floor portion 215 can be separate from the sidewall 210, the floor portion 215 can have a different number of seams 250 than the sidewall 210. Thus, the floor portion 215 can comprise a plurality of seams 250, while the integrated sidewall 210 can comprise only one. This is in contrast to conventional designs, wherein the floor and the sidewall are made from the same sheets and comprise the same number of seams. Accordingly, in some embodiments, the separate sidewall 210 and floor portion 215 decrease the likelihood of rupture by enabling a reduction in the number of seams 250 on the sidewall 210. The separate sidewall 210 and floor portion 215 also reduce the number of steps required during manufacturing, as the reduced complexity of the design requires fewer joining steps than traditional designs.

Embodiments of the present invention can also comprise one or more corner patches 220. The corner patches 220 can seal the holes left by the open corner sections 225 of the sidewall 210. In some embodiments, the corner patches 220 are smaller than the corner sections of traditional designs, reducing seam size and decreasing the likelihood of rupture. Moreover, the corner patches 220 can be joined with both the sidewall 210 and the floor portion 215 to provide a small seam 250 that is substantially round, minimizing the possibility that the seam 250 will break or tear. Accordingly, in some embodiments, the flexible sheets at the end of the floor portion 215 can comprise recessed corners 255. The recessed corners 255 can provide a surface with a substantially round contour to join with the rounded corner patches 220.

Embodiments of the present invention can further comprise a lower lip section 235 proximate the bottom of the integrated sidewall 210. In some embodiments, the lower lip section 235 is the bottom most portion of the sidewall 210, and can be configured to be joined with the floor portion 215. More specifically, in some embodiments, the lower lip section 235 can be configured to be joined with the perimeter, or an area proximate the perimeter, of the floor portion 215. In some embodiments, the seam that joins the floor portion 215 and the lower lip section 235 can be a substantially horizontal seam, i.e., a seam that is parallel with the floor portion 215 and/or the ground.

Embodiments of the present invention can comprise a lower lip section 235 that is sized, shaped, and oriented to provide significant advantages. The lower lip section 235, for example, can extend inward from the sidewall 210 and parallel to the ground at the area where the sidewall 210 joins with the floor portion 215. In this manner, the lower lip section 235 can ensure that, in a filled pool, hydrostatic pressure is applied downward on the seams 250 joining the sidewall 210 and the floor portion 215. As those of skill in the art will recognize, this is advantageous because the hydrostatic pressure can push the sidewall 210 and the floor portion 215 together against the ground. The ground can therefore support the seam 250, preventing rupture. On the other hand, any seams 250 on a vertical portion of the sidewall 210 would not be supported, and hydrostatic pressure could fatigue the seam 250.

The lower lip section 235 can be a variety of shapes and sizes. In some embodiments, as described above, the lower lip section 235 can be the bottom most portion of the sidewall 210, and can have a contour that matches the contour of the perimeter of the floor portion 215, thereby facilitating the act of joining the two components. The lower lip section 235 can also be disposed on all sides of the pool 200. In some embodiments, however, the lower lip section 235 can be disposed on less than all sides of the pool, such as only one, two, or three sides.

In some embodiments, in order to provide shape and support for the shell 205, the pool 200 can further comprise an upward force providing member. The upward force providing member can be a variety of components, such as, for example, a frame or flotation device.

As shown in FIG. 2, the sidewall 210 can comprise one or more receiving portions 240 for receiving a frame 245 (illustrated in FIG. 3). In some embodiments, the receiving portions 240 can be located proximate the top of the sidewall 210, and can comprise one or more conduits for receiving a top structure of the frame 245. The conduits can comprise apertures to allow supports of the frame 245 to engage the top structure. The supports can be, for example, vertical supports that hold the top structure of the frame 245 some distance above the ground. Thus, the supports can engage the top structure to hold the top structure, and the top of the sidewall 210, above the ground, enabling the pool 200 to be filled with water. Accordingly, the frame 245 can be assembled and mated with the receiving portions 240, providing upward support to the sidewalls 210 and shape to the pool 200. Once the frame and the shell are assembled, the pool 200 can be filled with water and used.

In some embodiments, the upward force providing member can be a floatation device. Thus, a top portion of the sidewall 210 can comprise a floatation device that floats on the water in the pool 200, causing the sidewall to rise as additional water is deposited in the pool 200. The floatation device can be positioned within the interior of the pool, i.e., on the inside of the sidewall 210, so that it is exposed to, and can float on, the water in the pool 200. More specifically, the inside of the top portion of the sidewall 210 can comprise a float. In this manner, the pool 200 can be filled with water, and the float can float on the water in the pool 200 to elevate the sidewalls.

Embodiments of the present invention can comprise a container, such as a pool 200, that can have a variety of shapes. The pool 200 can be, for example, substantially rectangular, rectangular with rounded corners, square, square with rounded corners, circular, oval, oblong, elliptical, triangular, pentagonal, hexagonal, octagonal, decagonal, and the like. Additionally, the pool can be made in a variety of sizes, depending upon the amount of space available and the desired use.

Embodiments of the present invention can also comprise a pool 200 with fewer components than traditional pools. More specifically, the use of the integrated sidewall 210 can reduce the number of components required to manufacture the sidewall 210 and the floor portion 215, thereby reducing the overall number of components required to manufacture the pool 200. Since fewer components are used, manufacturing costs can be decreased compared to conventional designs.

FIG. 3 illustrates an embodiment of an assembled pool 200 in accordance with the present disclosure. Pool 200 is shown with frame 245 supporting sidewall 210. Frame 245 may be made of any suitable material and may have any structure such that sidewall 210 is supported to retain fluid. As shown in FIG. 3, frame 245 may pass through one or more receiving portions 240 of sidewall 210.

Figure 4:
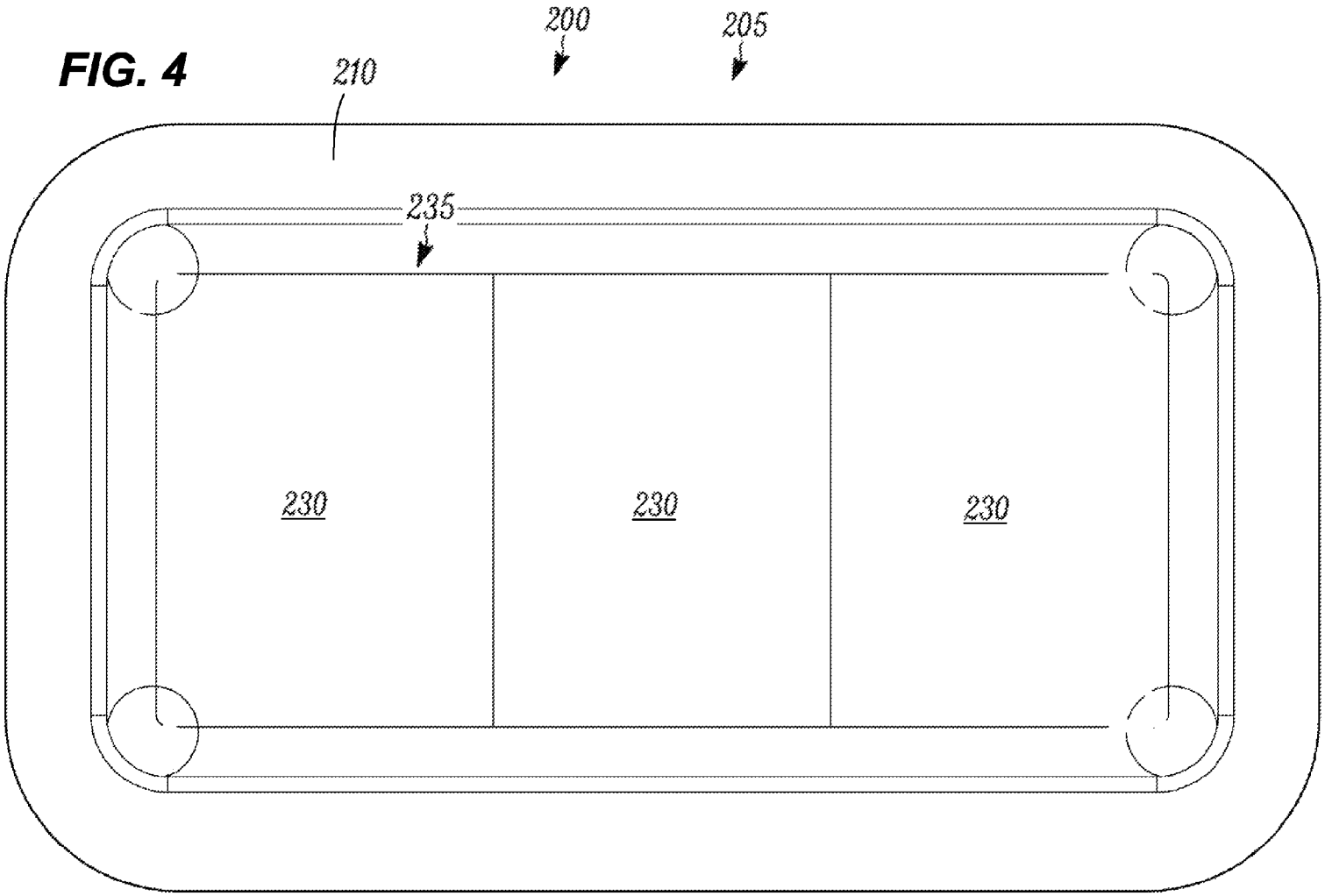
FIG. 4 is a birds-eye view of an improved pool, in accordance with some embodiments of the present invention.

A birds-eye view of a pool 200 in accordance with some embodiments is illustrated in FIG. 4. Sidewall 210, sheets 230, and lower lip section 235 are shown.

As described herein, portions of a flexible material are "joined," "joined together," or "joined with" each other. Other terms may also be used to describe how different portions of flexible material are joined or attached together. As used herein, these terms include various processes for joining at least two portions of flexible material. In some embodiments, for example, joining portions of flexible material can comprise welding the portions of flexible material together. In some embodiments, joining portions of flexible material can comprise melting the portions together. Joining portions of flexible material can further comprise RF welding, sewing, laminating, gluing, adhering, fastening, attaching, and sticking portions together. Thus, the various processes used to join portions of flexible material can include any process known to those of skill in the art.

Moreover, embodiments of the present invention can comprise several different flexible materials. The flexible materials can comprise, for example, PolyLaminate™ PVC. In some embodiments, the PolyLaminate™ PVC can optionally have polyester inner mesh sidewalls. The flexible materials can also comprise POLYTRENGTH™ PVC, optionally triple-layer POLYTRENGTH™ PVC. In other embodiments, the flexible materials can be various polymers, plastics, composites and/or other materials such as polyurethane, PVC, nylon, and/or other materials known in the art. In some embodiments, for example, the floor portion 215 and sidewall 210 of the pool 200 can be formed from a textile (e.g., burlap, etc.) or synthetic material (e.g., plastics, polyurethane, PVC, nylon, etc).

As will be understood by those of skill in the art, many materials can be used to construct a pool 200. The flexible materials, however, are preferably treated to retain water. For example, water-permeable materials could be adhered to, laminated with, coated with, or bonded to a material impermeable to water to create a usable flexible material. The floor portion 215 or sidewall 210, for example, can be formed from a nylon sheet, which can be laminated or otherwise treated to hold water. For example, the nylon sheet might be bonded to another material, such as a polyurethane, PVC, vinyl, or other suitable impermeable lining to provide the desirable waterproof qualities, and to provide a more pleasing tactile quality to the interior of the pool 200. Many of the flexible materials that are used can be selected for their durability.

Figure 5:
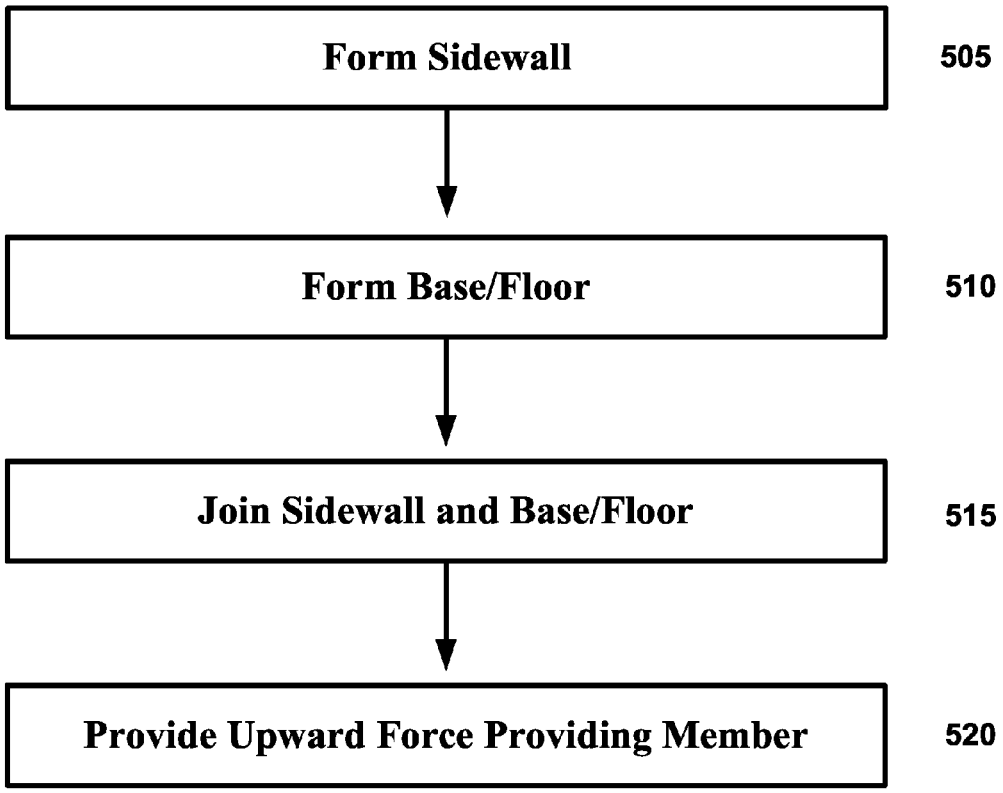
FIG. 5 is a flowchart depicting a method of making an improved pool, in accordance with some embodiments of the present invention.

As shown in FIG. 5, embodiments of the present invention can further comprise methods of making and using a container, such as a pool. For example, in some embodiments, a pool can be constructed by forming a sidewall 505, forming a base or floor portion 510, and joining the sidewall and floor portion together 515. An upward force providing member can optionally be mated with the sidewall to provide shape and support for the pool 520. These steps are elaborated on below.

In some embodiments, a sidewall can be formed from a single piece of flexible material. The sidewall can be formed to desired dimensions and can include a top, bottom, first end, and second end. The sidewall can also be formed to include open corner sections, as described above. The first end and second end of the sidewall can be joined together to form an integrated sidewall. The integrated sidewall can be joined to a floor portion, as shown in FIGS. 2-3.

In some embodiments, as described above, the floor portion can comprise one or more sheets of flexible material. In some embodiments, the sheets are first joined together to form a floor portion, and the floor portion is later joined with the sidewall. In alternate embodiments, however, the sheets are first joined with the sidewall, and are subsequently joined together.

In some embodiments, the corner patches can be joined to the sidewall and/or floor portion at any time during the manufacturing process. They can be joined with the sidewall and floor portion, for example, after the floor portion and the sidewall are joined together. In some embodiments, however, the corner patches are first joined with the sidewall and are later joined with the floor portion. In other embodiments, the corner patches are joined with the floor portion first and later joined with the sidewall.

After the shell is formed, a complete pool can be assembled. The upward force providing member can be mated with the shell to provide an upward force to the sidewall, giving the pool shape and support. In some embodiments, the upward force providing member can be a frame, and the frame can be constructed to provide shape and support to the shell. In other embodiments, the upward force providing member can be inflatable, and can likewise provide shape and support to the shell. After manufacturing and assembly, the pool can be used for enjoyment and relaxation.

Those of skill in the art will recognize that the method steps described herein can be performed in various orders, and thus the order of steps described above and shown in FIG. 5 is not limiting. For example, in some embodiments, a pool can be constructed by forming a base or floor portion 510 and later forming a sidewall 505.

As described above, in some embodiments, a pool or shell of the present invention can comprise fewer seams, and shorter seams, than traditional pools and shells. This is due, at least in part, to the reduced complexity of the design. The reduced number of seams, and reduced length of the seams, means that fewer joining steps are required during manufacturing. This can advantageously reduce costs and decrease manufacturing time.

While certain systems and methods related to containers, and specifically pools, have been disclosed in some exemplary forms, many modifications, additions, and deletions may be made without departing from the spirit and scope of the system, method, and their equivalents, as set forth in claims to be filed in a later, non-provisional application. The embodiments and claims disclosed herein are further capable of other embodiments and of being practiced and carried out in various ways. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other devices, methods, and systems for carrying out the several purposes of the embodiments and claims presented in this application. It is important, therefore, that the claims be regarded as including such equivalent constructions.

What is claimed is:

1. A fluid container, comprising:

a shell comprising:

a unitary sidewall having an upper portion and a lower portion, wherein the unitary sidewall is formed from a single sheet and defines the entire fluid container area;

the lower portion of the unitary sidewall comprising a lower lip section extending inward; and a floor portion attached to the lower lip section of the unitary sidewall with a floor seam, the floor seam configured to extend parallel to the ground such that, when the fluid container is filled with fluid, hydrostatic pressure is applied downward on the floor seam to push the lower portion of the integrated sidewall and the floor portion together against the ground; and a support for keeping the upper portion of the unitary sidewall elevated off the ground.

2. The container of claim 1, further comprising corner patches attached to both the unitary sidewall and the floor portion.

3. The container of claim 1, wherein the floor portion is formed from a single sheet.

4. The container of claim 1, wherein the floor portion comprises a plurality of sheets joined with horizontal seams.

5. The container of claim 1, wherein the unitary sidewall comprises one or more receiving portions for receiving a support frame.

6. The container of claim 1, wherein the support comprises one or more flotation devices on the upper portion of the unitary sidewall.

7. The container of claim 1, wherein the floor portion is rectangular, rectangular with rounded corners, square, square with rounded corners, circular, oval, oblong, elliptical, triangular, pentagonal, hexagonal, octagonal, or decagonal.

8. The container of claim 1, wherein the seams are created by welding, RF welding, sewing, laminating, gluing, adhering, fastening, attaching, or sticking one portion of the unitary sidewall to a second portion of the unitary sidewall.

9. The container of claim 1, wherein the unitary sidewall and floor portion comprise polyurethane, PVC, nylon, vinyl, or a textile coated with a material impermeable to water.

10. A method for assembling a fluid container, the method comprising:

providing a plurality of sheets of a flexible material, wherein at least one of the plurality of sheets is an integrated sidewall having an upper portion and a lower portion, the lower portion comprising a lower lip section extending inward, and the integrated sidewall formed from a single sheet and defining the entire fluid container area, and wherein at least another of the plurality of sheets is a floor portion;

joining a first portion of the integrated sidewall to a second portion of the integrated sidewall with a single sidewall seam; and joining the lower portion of the integrated sidewall to the floor portion with a floor seam, the floor seam configured to extend parallel to the ground such that, when the fluid container is filled with fluid, hydrostatic pressure is applied downward on the floor seam to push the lower portion of the integrated sidewall and the floor portion together against the ground.

11. The method of claim 10, wherein the method of joining two or more portions of the plurality of sheets comprises welding, RF welding, sewing, laminating, gluing, adhering, fastening, attaching, or sticking the portions together.

12. The method of claim 10, wherein the method further comprises joining two or more of the plurality of sheets to form the floor portion with one or more seams.

13. The method of claim 10, wherein the method further comprises:

providing a plurality of corner patches; and joining the corner patches to the integrated sidewall and the floor portion with a single seam.

14. The method of claim 10, wherein the method further comprises providing a support for keeping an upper portion of the integrated sidewall elevated above the floor portion.

15. The method of claim 14, wherein the support comprises a frame.

16. The method of claim 15, wherein the method further comprises connecting the upper portion of the integrated sidewall to the frame.

17. The method of claim 14, wherein the support comprises a floatation device connected to the upper portion of the integrated sidewall.

18. The method of claim 10, wherein providing a plurality of sheets of a flexible material comprises providing a plurality of sheets of polyurethane, PVC, nylon, vinyl, or a textile coated with a material impermeable to water.

19. A fluid container, comprising:

a shell comprising:

an integrated sidewall formed from a single sheet and defining the entire fluid container area, the integrated sidewall comprising:

an upper portion comprising a receiving portion;

a lower portion comprising a lower lip section extending inward; and a single seam that attaches a first portion of the integrated sidewall to a second portion of the integrated sidewall;

a floor portion attached to the lower lip section of the integrated sidewall with a floor seam, the floor seam configured to extend parallel to the ground such that, when the fluid container is filled with fluid, hydrostatic pressure is applied downward on the floor seam; and at least one corner patch attached to both the integrated sidewall and the floor portion; and a frame connected to the receiving portion for keeping the upper portion elevated off the ground.

* * * * *